United States Patent [19]

Moody

[11] Patent Number: 4,519,428

[45] Date of Patent: May 28, 1985

[54] CUP MARKING ATTACHMENT FOR BEVERAGE DISPENSING MACHINES

[75] Inventor: Albert L. Moody, Lawrenceville, Ga.

[73] Assignee: F. C. Brown Rentals, Inc., Atlanta, Ga.

[21] Appl. No.: 393,706

[22] Filed: Jun. 30, 1982

[51] Int. Cl.[3] ..... B65B 3/04

[52] U.S. Cl. ..... 141/98; 141/360; 101/41

[58] Field of Search ..... 141/98, 351–362; 222/129.1; 101/41; 227/120

[56] References Cited

U.S. PATENT DOCUMENTS

| | | | |
|---|---|---|---|
| 3,190,054 | 6/1965 | Arnold et al. | 101/41 |
| 3,269,606 | 8/1966 | Armstrong | 141/360 |
| 3,682,207 | 8/1972 | Rickard et al. | 141/98 |
| 3,835,897 | 9/1974 | Gess | 141/98 |
| 3,878,776 | 4/1975 | Schneider | 101/41 |
| 3,892,335 | 7/1975 | Schroeder | 222/129.1 |
| 4,180,197 | 12/1979 | Raasch et al. | 227/120 |

*Primary Examiner*—Houston S. Bell, Jr.

*Attorney, Agent, or Firm*—Schlesinger, Arkwright, Garvey & Fado

[57] ABSTRACT

A cup marking attachment for beverage dispensing machine having a plurality of nozzles for dispensing different flavors or brands of drinks. The attachment comprises a plurality of stamp members containing marking material and indicia mounted adjacent each of the nozzles for identifying the beverage being dispensed by that nozzle. As a drink cup is placed beneath the selected nozzle, the indicia of the stamp member engages the side of the cup and imprints the flavor or brand of the beverage thereon.

16 Claims, 6 Drawing Figures

CUP MARKING ATTACHMENT FOR BEVERAGE DISPENSING MACHINES

BACKGROUND OF THE INVENTION

In food establishments such as fast food outlets, there are conventionally provided beverage dispensing machines capable of dispensing a large number of beverages of different brands and flavors. These beverages are usually poured into disposable paper cups having the same appearance and bearing no markings to identify the cup's contents.

When a beverage order includes a number of different brands and flavors, it is extremely difficult to determine the contents of each cup by visual inspection. Identification is further complicated by the placement of lids over the cups to prevent spillage.

As a consequence of this problem, mixups occur and persons get the wrong drink and do not discover the error until tasting the beverage.

One way in which this confusion can be resolved is by using paper cups of different colors or having different designs or markings thereon. However, this requires a large inventory of cups, and the cups must be carefully selected by the person filling the order in order to avoid the error of filling the selected cup with the incorrect beverage.

SUMMARY OF THE INVENTION

The present invention is an attachment for beverage dispensing machines which automatically marks a paper cup to identify the beverage in the cup as the cup is being filled.

The attachment includes a marking member having indicia on the face thereof, a series of attachments being affixed to the dispensing machines adjacent each nozzle thereof, and the indicia of each attachment being different. The attachment is positioned in the path of the cup as it is placed beneath the nozzle for filling, the outer wall of the cup engaging the marking member indicia to transfer the mark of the indicia to the cup wall to identify the cup's contents.

The present attachment further includes articulate means for orienting the marking member indicia to compensate for positioning of the cup at various angles to the vertical when being filled, to insure that the marker indicia is disposed in flush engagement with the outer wall of the cup.

DESCRIPTION OF FORM OF THE INVENTION ILLUSTRATED IN FIGS. 1 TO 5

Figure 1:
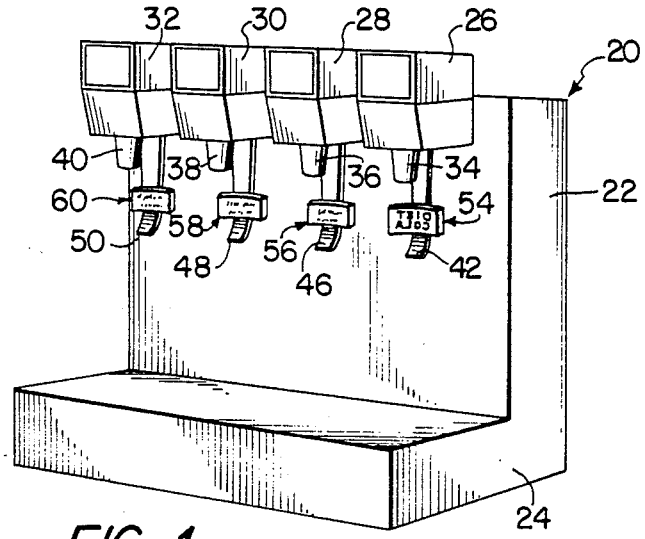
FIG. 1 is a perspective view of a beverage dispensing machine illustrating the attachment of the present invention.
Figure 2:
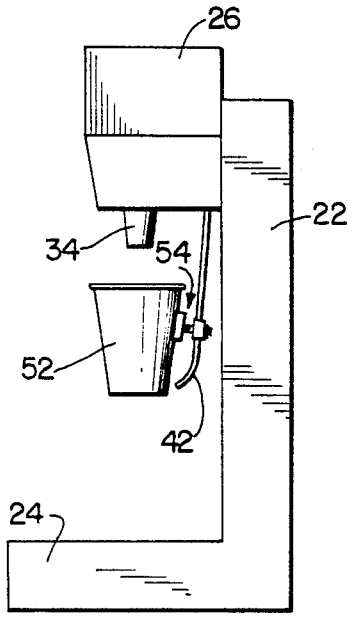
FIG. 2 is a side elevational view of the machine of FIG. 1 illustrating the use of the present invention.

In FIGS. 1 and 2, there is illustrated a standard beverage dispensing machine generally designated 20 including a vertical portion 22 and a horizontal portion 24. A plurality of taps 26, 28, 30 and 32 are mounted on vertical portion 22 for dispensing different brands or flavors of beverages through nozzles 34, 36, 38 and 40 respectively.

Nozzles 34, 36, 38 and 40 are actuated by operating levers 42, 46, 48 and 50, which are urged towards vertical portion 22 of machine 20 when a disposable paper cup 52 is placed beneath the nozzle for filling.

In accordance with the present invention, marking attachments generally designated 54, 56, 58 and 60 are mounted on dispensing levers 42, 46, 48 and 50 respectively. As shown to advantage in FIGS. 4 and 5, each marking attachment comprises a transversely arcuate receptacle including a backwall 62 and upstanding side and end walls 64, forming a recess in which an ink impregnated stamp pad 66 of any suitable material is placed, the outer surface of the pad conforming to the arcuate contour of the receptacle.

In accordance with the present invention, indicia such as indicated at 68, 70, 72 and 74 extends outwardly from the outer surface of stamp pad 66, which indicia may be in the form of lettering or other suitable markings, and which varies, the indicia of each of the marking members 54, 56, 58 and 60 being different, and identifying the beverage being dispensed by each of nozzles 34, 36, 38 and 40.

A flange 76 is mounted on the central rear portion of wall 62, and extends between a pair of spaced ears 78 and 80, which are secured to a wall of a tubular sleeve 82 which is removably positioned on operating lever 42 by a setscrew 84. A pin 86 extends through ears 78 and 80 and flange 76 to provide pivotal movement of stamp pad 66 and its receptacle in a vertical plane, as shown in phantom lines in FIG. 4.

The attachment of the present invention extends forwardly of operating lever 42, and lies in the path of movement of the cup as it is placed beneath nozzle 34, as shown in FIG. 2. The outer wall of the cup engages the present attachment and forces the latter rearwardly of the dispensing machine which, by virtue of the connection thereof with operating lever 42, also effects rearward movement of the lever to actuate the valve for filling cup 52 to nozzle 34.

Figure 3:
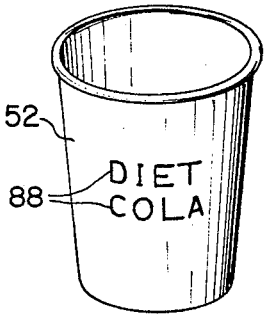
FIG. 3 is a perspective view of a cup showing the application of indicia by means of the attachment of the present invention.

When the sidewall of the cup engages the indicia on the surface of pad 66, the image of the indicia is transferred to the side of the cup as indicated at 88 in FIG. 3.

Figure 4:
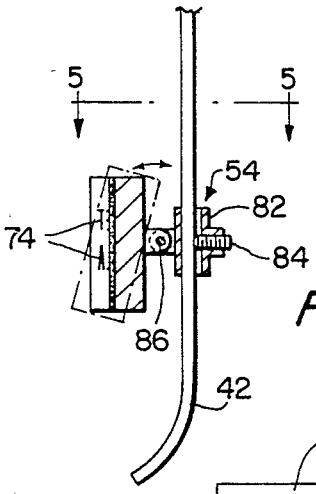
FIG. 4 is an enlarged fragmentary side elevational view illustrating the attachment of the present invention mounted on a dispensing lever of a beverage dispensing machine.
Figure 5:
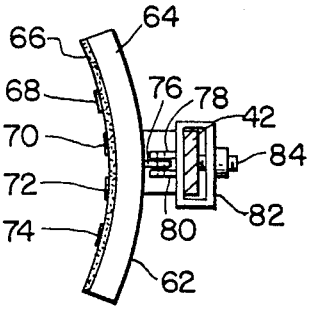
FIG. 5 is a sectional view taken along the line 5—5 of FIG. 4, looking in the direction of the arrows.

It should also be noted that, by virtue of the pivotal engagement of stamp pad 66 and its receptacle with sleeve 82, in the event that cup 52 is placed under nozzle 34 at an angle to the vertical position shown in FIG. 2, the marking pad and receptacle will rotate in an arc in a vertical plane as shown in FIG. 4 in order to effect flush engagement of the indicia on the marking pad with the sidewall. This insures the transfer of the entire image of the indicia to the sidewall of the cup so that a clear indication of the contents of the cup appears on the outer wall thereof.

DESCRIPTION OF FORM OF THE INVENTION ILLUSTRATED IN FIG. 6

Figure 6:
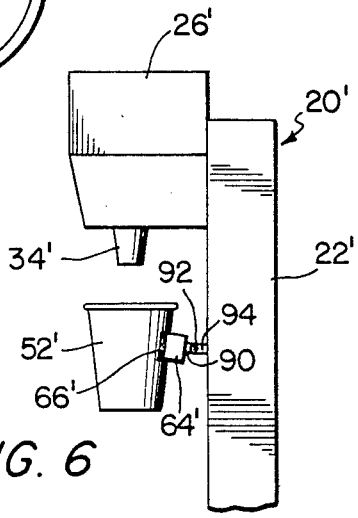
FIG. 6 is a side elevational view of a beverage dispensing machine illustrating a modified form of the present invention.

In FIG. 6, there is illustrated a modified form of the attachment of the present invention illustrated in FIGS. 1 to 5. This form of the invention is particularly adapted for use with beverage dispenser machines of the type which, instead of employing an operating lever for actuating the valve to dispense the beverage from nozzle 34, employs a button (not shown) which is depressed to pour the beverage into the cup.

In FIG. 6, portions thereof which are similar to the form of the invention illustrated in FIGS. 1 to 5 are indicated by like, primed numbers. Just as in the form of the invention illustrated in FIGS. 1 to 5, the attachment of the modified form of the invention includes a receptacle of transversely arcuate shape holding an ink impregnated pad 66′ on the outer surface of which is indicia for transferring the image of the indicia to the wall of a paper cup 52′. In accordance with this form of the invention, a flange 90 is mounted on a central portion of rear wall 62. Flange 90 is pivotally connected at 92 to a link 94 which is mounted in any suitable fashion on vertical wall 22′ of the drink dispenser machine 20.

The operation of the present attachment in this form of the invention is the same as in the form of the invention illustrated in FIGS. 1 to 5, it being noted that the attachment lies in the path of movement of cup 52′ as it is placed beneath nozzle 34′ for pouring the beverage into the cup.

The attachment of the present invention affords simple, economic means for positively and automatically applying a marking to the cup or other container being filled from the selected nozzle of a drink dispensing machine for identifying the contents of the cup. The present attachment may further be quickly installed and replaced and in no way interferes with the normal operation of the beverage dispensing machine. It further eliminates any possibility of confusion as to what beverage is contained in the cup and is automatically operable without any intervention or action on the part of the person filling the cup.

While there has been herein shown and described the presently preferred forms of this invention, it is to be understood that such has been done for purposes of illustration only, and that various changes may be made therein within the scope of the appended claims.

What is claimed is:

1. A beverage dispensing machine attachment for applying indicia to the outer wall of a cup being filled from a selected nozzle of the machine, to identify the contents of the cup, the attachment including
   (a) a marking member having indicia on one surface thereof, and
   (b) mounting means for positioning said marking member on said beverage dispensing machine adjacent a nozzle which dispenses a beverage identified by the indicia adjacent thereto
   (c) said marking member lying in the path of the cup when it is placed beneath the nozzle for filling, whereby the marking member indicia engages the side wall of the cup to transfer the image of the indicia to the cup wall.

2. The beverage dispensing machine attachment of claim 1, wherein
   (a) said marking member is transversely arcuate to conform to the contour of the cup wall.

3. The beverage dispensing machine attachment of claim 1, with the addition of
   (a) articulate means for pivotally connecting said marking member to said mounting means to permit orientation of the marking member indicia to compensate for positioning of the cup at various angles to the vertical when being filled.

4. The beverage dispensing machine attachment of claim 1, with the addition of
   (a) a plurality of marking members corresponding to the number of nozzles on the machine and mounted adjacent thereto
   (b) said marking members bearing indicia which are different from each other and which identify the beverage being dispensed from the adjacent nozzle.

5. The beverage dispensing machine attachment of claim 1, wherein
   (a) said mounting means is fixed to a stationary part of said beverage dispensing machine.

6. The beverage dispensing machine attachment of claim 1, wherein
   (a) the beverage is dispensed through the nozzle by actuation of an operating lever adjacent the nozzle, and
   (b) said mounting means is positioned on said operating lever.

7. A drink dispensing machine of the type having a dispensing nozzle controlled by a dispensing lever actuated by engagement with the side of a cup for filling the latter, an attachment for applying indicia to the cup to identify the contents thereof, the attachment including
   (a) a marking member having indicia on one surface thereof
   (b) said marking member being of transversely arcuate shape to conform to the contour of the cup
   (c) mounting means engaged with the dispensing lever, and
   (d) means for connecting said marking member to said mounting means.

8. The attachment of claim 7, wherein
   (a) said means is pivotally engaged with said mounting means.

9. The attachment of claim 7, wherein
   (a) said mounting means includes a tubular member in sleeved engagement with the dispensing lever, and
   (b) securing means for retaining said mounting means in engagement with the dispensing lever.

10. The attachment of claim 9, wherein
   (a) said securing means is a setscrew extending through said tubular member into retaining engagement with the dispensing lever.

11. A beverage dispensing machine attachment for applying indicia markings to the outer wall of a cup being filled from a selected nozzle of the machine, to identify the contents of the cup, the attachment including
   (a) a marking member comprising a receptacle
   (b) an ink impregnated pad positioned in said receptacle
   (c) indicia extending outwardly from the outer surface of said ink impregnated pad, the ink from the pad being transferred to the indicia
   (d) mounting means for connecting said marking members to said beverage dispensing machine adjacent a nozzle which dispenses a beverage identified by the marking member indicia
   (e) said marking member lying in the path of the cup when it is placed beneath the cup for filling, whereby the marking member engages the side wall of the cup to transfer the image of the indicia to the cup wall.

12. The beverage dispensing machine attachment of claim 11, wherein (a) said marking member is transversely arcuate to conform to the general contour of the cup wall.

13. The beverage dispensing machine attachment of claim 12, wherein (a) said mounting means is fixed to a stationary part of said beverage dispensing machine.

14. The beverage dispensing machine attachment of claim 11, wherein (a) the beverage is dispensed through the nozzle by actuation of an operating lever adjacent the nozzle, and (b) said mounting means is positioned on said operating lever.

15. The beverage dispensing machine attachment of claim 11, with the addition of (a) means for pivotally connecting said marking member to said mounting means to permit orientation of said marking member to compensate for positioning of the cup at an angle to the vertical when being filled.

16. The beverage dispensing machine attachment of claim 11, with the addition of (a) a plurality of marking members corresponding to the number of nozzles on the dispensing machine (b) each of said marking members including a receptacle, an ink impregnated pad within the receptacle and indicia extending outwardly from the outer surface of said ink impregnated pad, the ink from the pad being transferred to the indicia (c) the indicia of each marking member being different from one another, to identify the beverage being dispensed by the adjacent nozzle (d) mounting means for connecting each of said marking members to said beverage dispensing machine adjacent a nozzle which dispenses a beverage identified by the particular marking member indicia (e) each of said marking members lying in the path of a cup when it is placed beneath the selected nozzle for filling, whereby the marking member indicia engages the wall of the cup to transfer the image of the indicia to the cup wall.

* * * * *